United States Patent [19]

Jansz

[11] 4,102,147

[45] Jul. 25, 1978

[54] SUBMERSIBLE POSITIONING AND GUIDING APPARATUS FOR PILE DRIVING

[75] Inventor: Joost W. Jansz, The Hague, Netherlands

[73] Assignee: Hollandsche Beton Groep NV, Rijswijk, Netherlands

[21] Appl. No.: 663,609

[22] Filed: Mar. 3, 1976

[30] Foreign Application Priority Data

Oct. 13, 1975 [NL] Netherlands ..... 7512022

[51] Int. Cl.[2] ..... E02D 7/00; E02D 7/02

[52] U.S. Cl. ..... 61/53.5; 173/DIG. 1

[58] Field of Search ..... 61/53.5, 53, 63, 97; 173/DIG. 1, 43

[56] References Cited

U.S. PATENT DOCUMENTS

| | | | |
|---|---|---|---|
| 2,422,168 | 6/1947 | Kirby | 61/97 |
| 3,001,370 | 9/1961 | Templeton | 61/92 |
| 3,294,051 | 12/1966 | Khelstovsky | 61/92 X |
| 3,502,159 | 3/1970 | Pogonowski | 173/DIG. 1 |
| 3,611,734 | 10/1971 | Mott | 61/97 |
| 3,832,858 | 9/1974 | Anders | 61/53.5 |
| 3,871,617 | 3/1975 | Majima | 61/53.5 X |
| 3,888,317 | 6/1975 | Walters | 173/43 |

*Primary Examiner*—Dennis L. Taylor

*Attorney, Agent, or Firm*—Sughrue, Rothwell, Mion, Zinn and Macpeak

[57] ABSTRACT

A submersible pile driving support and guide apparatus includes a tripod-like frame 8 having vertically adjustable foot pads 16, 17, a lower guide ring 21 horizontally positionable by pivotally mounted hydraulic cylinders 19, upper guiding and clamping rods 23 fully retractable into cylinders 22, and a floodable ballast tank 18. The pile 7 may be positioned vertically or at an angle by suitably adjusting the foot pads, the lower guide ring and the rods. Once it is driven down to the top of the apparatus the rods 23 are retracted into their cylinders, and the driving head 26 thereafter reciprocates within the vertical posts 9 of the frame to complete the driving.

5 Claims, 4 Drawing Figures

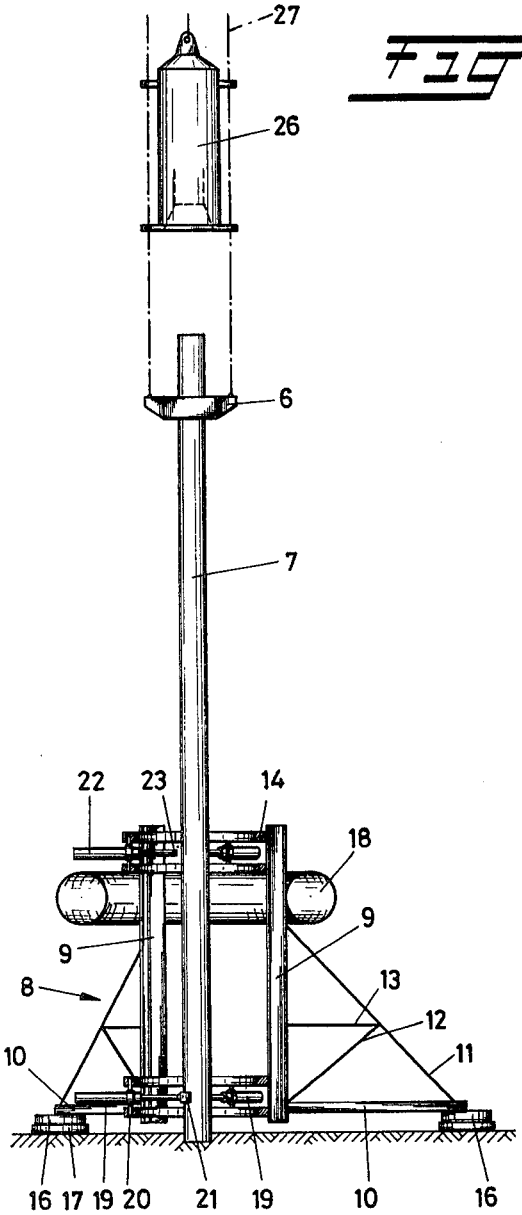
FIG. 3
FIG. 4
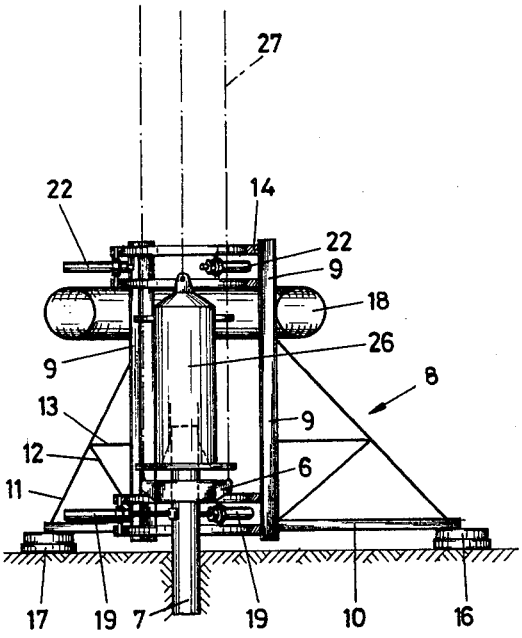

SUBMERSIBLE POSITIONING AND GUIDING APPARATUS FOR PILE DRIVING

BACKGROUND OF THE INVENTION (1) Field of the Invention

The present invention relates to a submersible apparatus for keeping a marine pile to be driven into the ground in a pre-determined upright position under water.

(2) Description of the Prior Art

It is known in the prior art to provide a pile which must be driven into the ground with a support having frictional contact with the pile, which support is destroyed at the end of the pile-driving operation. This prior art support is not suitable to accurately handle piles of considerable length, and is considered only as an auxiliary means when positioning a pile which at the beginning of the pile-driving process is still suspended by the cables with which the pile was lowered.

SUMMARY OF THE INVENTION

It is an object of the present invention to provide an apparatus by which a pile to be lowered may be given a highly accurate vertical position or angle, which may fully support the pile after it has been lowered, without the aid of hoisting cables, and which, in addition, may be recovered.

In accordance with the invention, this object is achieved in that the positioning elements bearing against the pile above the ground and near the top of the apparatus may be moved out of the path of the pile-driving device, and that below these elements the main vertical frame members form a passage for the reciprocating pile-driving device. Because these positioning elements may be moved out of the path of the pile-driving device and no other obstacles are present between said device and the ground, it is possible to move the pile-driving device down through the center of the apparatus. Consequently, the support means as such may act on the pile at a considerable distance from the ground and may support the pile in an effective manner in the correct position. Said position may be truly vertical or at an angle to the vertical, and said angular position may be provided in that the laterally projecting support legs of the apparatus are provided with feet which are adjustable for height, or in that the positioning elements acting on the pile are adjustable in such a manner that they may support the pile in an eccentric position.

The apparatus is provided with ballast tanks with controllable buoyancy, the advantage of which is not only that the submerged apparatus may be recovered after use by floating it, but that it is also possible to insert the pile into the support means while the apparatus is at the surface in the proximity of the vessel from which the pile-driving operation is carried out. The apparatus may then be lowered together with the pile in a controlled manner, in which the pile and the support apparatus move downwardly together. It is possible to verify that the pile has the correct position in the support apparatus prior to lowering the whole unit onto the ground, and minor corrections as to the position may be carried out with the aid of the adjustable supporting feet.

BRIEF DESCRIPTION OF THE DRAWINGS

In the drawings:

FIG. 3 illustrates the apparatus after having been lowered with a pile onto the ocean floor, and FIG. 4 illustrates the lowered apparatus when the process of pile-driving has been terminated.

DESCRIPTION OF THE PREFERRED EMBODIMENT

Figure 1:
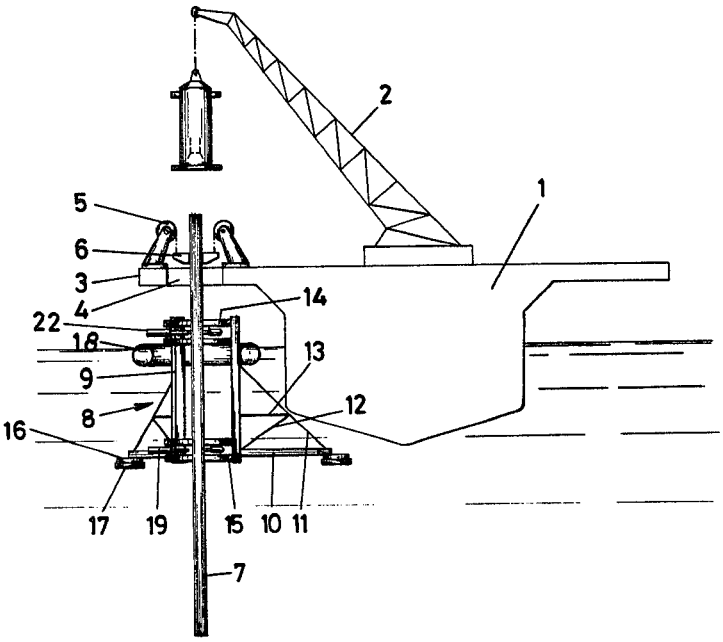
FIG. 1 is a diagrammatic side view of an apparatus in accordance with the invention at surface level.
Figure 2:
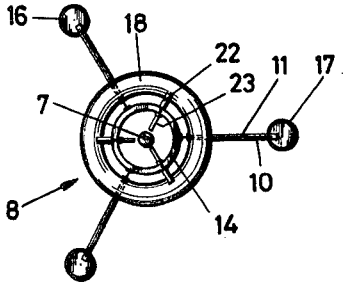
FIG. 2 is a top view of the apparatus.

FIG. 1 shows a vessel 1 with a hoisting crane 2 and a side platform 3 directed outwards with a passage 4 and winches 5 disposed above said passage. Pile 7 is suspended on said winches by means of a crossbar 6.

The apparatus of the invention comprises a frame generally indicated by reference numeral 8 and consisting of at least three vertical support posts 9 having horizontally projecting arms 10 which form a rigid, integral structure with the lattice members 11, 12 and 13. Structural elements 9 to 13 are held together by annular frame rings 14 and 15. The horizontal arms 10 have supporting feet 16 with lower pads 17, said pads being movable in a vertical direction. The elements 16 and 17 are hydraulically or mechanically movable with respect to each other by means known per se.

At its upper end the apparatus is provided with one or more ballast tanks 18 connected to remotely controlled means for admitting water to the tanks and for blowing water out of them so that the buoyancy of the apparatus can be regulated. At the level of horizontal arms 10 the apparatus may be provided with a bottom plate with a passage opening for pile 7. Said plate is not illustrated in the drawings. Instead, a number of cylinders 19 are shown, e.g. three, said cylinders being pivotably disposed about vertical axes 20 in the frame and being hinged to a ring 21 which acts as a guide for pile 7. With the aid of said cylinders it is possible to give the ring 21 a central position inside posts 9 or an eccentric position.

The upper end of the apparatus is provided with double-acting cylinders 22 whose piston rods 23 may be fully retracted. Said rods, when extended, bear against the pile 7 and clamp it in position.

The cylinders 22 may also be rotatably arranged in the same manner as the cylinders 19, and the outer ends of the rods 23 acting on the pile may be provided with arcuate pads hinged to the rods and embracing part of the circumference of the pile. It is then possible to achieve an eccentric upper position of the pile by selectively adjusting the extensions of said cylinders.

With the apparatus of the invention it is thus possible to bring the pile into various positions. A truly vertical position is achieved when the pile is held down in the frame on the vertical center line, in which ring 21 has a central position and rods 23 clamp the pile equidistant from the posts 9. When the frame rests on uneven ground in a position which does not quite provide a truly vertical orientation of the pile, it is possible to correct this by adjusting the pads 17 relative to their respective feet 16. It is also possible to establish a slight angle to the vertical by suitably adjusting the pads 17.

It is further possible to give the pile 7, on positioning it in the frame at water-level (as illustrated in FIG. 1), an inclined orientation by the eccentric positioning of ring 21 and the pads at the ends of rods 23, provided that cylinders 22 are rotatably secured in the frame about a vertical axis. Consequently, it is possible, with this apparatus, to drive piles into the ground at an angle.

FIG. 3 illustrates the position which is reached when the apparatus and a pile clamped therein have reached the ocean floor. Tanks 18 are fully filled with water as ballast so that the apparatus is firmly positioned on the ground. After any necessary correction of the pile position by adjustment of the pads 17, the pile-driving apparatus 26 may be positioned onto the pile head via cables 27 running down from the winches. The process of pile-driving may then take place until the pile has been driven into the ground to a sufficient extent. Rods 23 are then retracted so that the pile-driving apparatus may drive the pile further into the ground, as illustrated in FIG. 4, by reciprocating within the space between the vertical support posts 9 of the frame. The crossbar 6 may then be disconnected and lifted again with the aid of cables 27, simultaneously with the pile-driving apparatus. The support apparatus may be recovered by blowing water out of the ballast tanks 18 whereupon the apparatus will rise to the surface and may be used again for the positioning and driving of the next pile.

Although the disclosed apparatus is suitable for supporting piles of any length, it is particularly suitable for piles of considerable length, such as 100 m. In such a case the apparatus will be dimensioned so that about ⅓ of the length of the pile will be supported therein.

What is claimed is:

1. Apparatus for guiding and supporting a pile during submerged pile-driving by means of a pile-driving hammer to be placed on top of the pile, said apparatus comprising: a frame assembly having at least three radially projecting arms, said arms having footpads at the outer ends thereof for supporting the apparatus on the ocean floor, said frame assembly having at least three vertically extending posts placed at equal distances from each other around a central axis of the apparatus and at equal distances from said axis, said frame defining a guide passage for a pile proximate the lower ends of the posts, said frame carrying radially movable inwardly extending guide members proximate the upper ends of the posts for guiding said pile and means attached to said frame assembly for submerging and raising said apparatus in water.

2. Apparatus in accordance with claim 1 wherein the radially movable inwardly extending guide members proximate the upper end of the posts are formed by telescopic rods engaging the pile with shoes bearing on part of the circumference of the pile, said shoes being hinged about vertical axes to the rods and said rods being rotatably mounted about vertical axes in the frame interconnecting the posts.

3. An apparatus in accordance with claim 1, wherein said guide passage includes radially adjustable piston means for positioning and guiding the pile.

4. An apparatus in accordance with claim 1, wherein said guide passage includes eccentrically adjustable means for positioning and guiding the pile.

5. An apparatus in accordance with claim 3, wherein said guide passage includes a ring through which the pile may be guided, said piston means being hinged to said ring by adjusting means disposed in the frame, said adjusting means pivoting about vertical axes.

* * * * *